United States Patent [19]

Tarpley, Jr. et al.

[11] Patent Number: 4,652,383

[45] Date of Patent: Mar. 24, 1987

[54] VINYL POLYMER GELLING AGENT FOR POWDER DISSEMINATION COMPOSITION

[75] Inventors: William B. Tarpley, Jr., Downingtown; Gerald L. Ruscitto, South Coatesville, both of Pa.

[73] Assignee: Cease Fire, L. P., Berwin, Pa.

[21] Appl. No.: 820,927

[22] Filed: Jan. 21, 1986

Related U.S. Application Data

[63] Continuation of Ser. No. 701,650, Feb. 14, 1985, abandoned, which is a continuation of Ser. No. 506,485, Jun. 21, 1983, abandoned.

[51] Int. Cl.[4] ..... A62D 1/00

[52] U.S. Cl. ..... 252/8; 252/2; 252/3; 252/7

[58] Field of Search ..... 252/8, 2, 3, 7, 316, 252/317

[56] References Cited

U.S. PATENT DOCUMENTS 4,226,727 10/1980 Tarpley, Jr. et al. ..... 252/8

4,226,728 10/1980 Kung ..... 252/8

4,234,432 11/1980 Tarpley, Jr. ..... 252/8

OTHER PUBLICATIONS

"Hydrophilic Polymers–Carbopol 910 Product Specification", B.F. Goodrich, (Mar. 1976).

"Carbopol ® Water Soluble Resins", BF Goodrich, p. 15 (GC–67), Sep. 1980.

*Primary Examiner*—John F. Terapane

*Assistant Examiner*—Anne Brookes

*Attorney, Agent, or Firm*—Seidel, Gonda, Goldhammer & Abbott

[57] ABSTRACT

A gelled concentrate composition contains 70 to 30 weight percent gelled liquid and 30 to 70 weight percent solids component. The solids component comprises a fine powder of an ammonium compound and a vinyl polymer gelling agent. The gelling agent is present in the amount of 0.5 to 8.0 weight percent of the total composition. The resulting gelled concentrate, stable up to 18 months in storage, is useful in extinguishing fires.

19 Claims, No Drawings

VINYL POLYMER GELLING AGENT FOR POWDER DISSEMINATION COMPOSITION

This is a continuation, of application Ser. No. 701,650, filed Feb. 14, 1985, now abandoned, which is in turn a continuation of applicaton Ser. No. 506,485, filed June 21, 1983, now abandoned.

BACKGROUND OF THE INVENTION

The present invention relates to a vinyl polymer gelling agent for powder suspensions in liquified gas.

Liquified gases have been used to disseminate fine powders including pesticides, medicinal and cosmetic products, and fire extinguishing powders. To prevent the packing and clogging of these powders, gelling agents such as Cab-O-Sil (a trademark of the Cabot Corporation) have been used. Gelled liquid suspensions of powders are taught in U.S. Pat. No. 4,234,432 of Tarpley, Jr., which is believed to be the closest prior art. Gelling agents are set forth therein at column 5, lines 15–37. However, there is a need for a suspensoid system of improved stability.

It has been found that a suspensoid of remarkable and improved stability has resulted from the addition of vinyl polymer in small amounts as a gellant.

SUMMARY OF THE INVENTION

A composition is provided comprising a gelled liquid, a vinyl polymer gelling agent, and an ammonium compound. The preferred proportion of these materials is about 70–30 weight percent gelled liquid and 30–70 weight percent solids, the latter comprising the vinyl polymer gelling agent and ammonium compound.

The preferred vinyl polymer is a Carbopol. The Carbopol polymers of this invention have an average equivalent weight of about 76±4, a molecular weight of from about 450,000 to about 4,000,000, and the general structure:

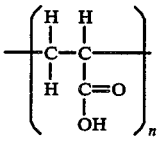

(sold by B. F. Goodrich under the trademark Carbopol for water soluble resins). These polycarboxylated vinyl resins have Brookfield viscosities (cP) as measured on a Brookfield viscometer, model RVF or RVT at approximately 25° C. in a range of from about 4,000 to 60,000 measured on a 0.5% solution and about 3,000 to 7,000 measured on a 1% solution. Particular Carbopol polymers have viscosities of from about 30,500 to 39,400 (average molecular weight about 3,000,000); 40,000 to 60,000 (average molecular weight about 4,000,000); and 4,000 to 11,000 (average molecular weight about 1,250,000) measured on a 0.5% solution and 3,000 to 7,000 (average molecular weight about 750,000) measured on a 1% solution. The concentration of Carbopol in the composition is about 0.5 to 8.0 weight percent, with 3.5% being preferred. The preferred ammonium compound is monoammonium phosphate. The preferred gelled liquid comprises the liquified gases trifluorobromomethane and difluorochlorobromomethane, and mixtures thereof.

DETAILED DESCRIPTION OF THE INVENTION

A suspension of powder in a gelled liquid of increased stability results from the present invention. A vinyl gelling agent is used to form suspensions which are thixotropic and exhibit excellent stability. The preferred composition is a suspension of monoammonium phosphate powder suspended in a mixture of liquified trifluorobromomethane and difluorochlorobromomethane by Carbopol.

The gelled liquid component of the present composition includes one or more fire-quenching liquids in combination with one or more fire-quenching liquified gases and/or one or more overpressurizing gases. If a fire-quenching liquified gas (e.g. trifluorobromomethane) is used, the fire-quenching liquid may be omitted.

The gelled liquid component must be capable of filling the interparticulate spaces in the suspension under pressure, i.e., when the suspension is at rest. It must also be capable of expanding upon release of pressure to a gaseous vapor or droplet cloud carrying the fire-extinguishing particles. Finally, the gelled liquid component must provide some measure of fire quenching capability.

Fire-quenching liquids useful in the gelled liquid component include, but are not limited to, the following: methylene bromide, methyl iodide, tetrafluorodibromoethane, trifluorotrichloroethane, fluorotrichloromethane, chloroform, bromoform, carbon tetrachloride, and the like.

Liquified gases which may be used according to the present invention include, but are not limited to, the following: trifluorobromomethane, difluorochlorobromomethane, perfluoropropane, perfluorocylobutane, dichlorodifluoromethane, tetrafluoromethane, methyl bromide, trifluoromethane, trifluorochloromethane, hexafluoroethane, and the like. Also suitable are the Halon mater ials. "Halon" is the National Fire Protection Association designation for halogenated fire extinguishing materials. Halon products are available from Great Lakes Chemical Company, DuPont Company, and ICI Americas, Inc. Halon 1211 (difluorochlorobromomethane), Halon 1301 (trifluorobromomethane), and mixtures thereof, are particularly useful. Overpressurizing gases useful in the gelled liquid component include nitrogen, cabon dioxide, helium, argon, and the like.

The gelled liquid component comprises from about 70 to about 30 percent by weight of the composition according to the present invention.

The solids component, comprising from about 30 to 70 weight percent of the present composition contains one or more powdered compounds of ammonium and a vinyl polymer gelling agent. Nonlimiting examples of suitable powdered ammonium compounds include mono-, di-, and triammonium phosphate, and ammonium calcium phosphate. Monoammonium phosphate (MAP) powder is particularly useful. ABC dry chemical fire-extinguishing powder, which is 90 to 95 percent MAP, is preferred as MAP.

Other fire-extinguishing powders may be used in conjunction with one or more ammonium compounds. Such powders include sodium bicarbonate, potassium bicarbonate, sodium chloride, potassium chloride, and the like.

The preferred gelling agent, comprising from about 0.5 to 8.0 weight percent of the composition, is a Carbopol (trademark of the B. F. Goodrich Chemical Company), a family of water-soluble polycarboxylated vinyl polymers having an average equivalent weight of about 76±4, a molecular weight from about 450,000 to about 4,000,000, and the general structure:

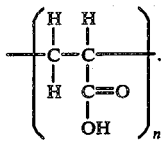

Carbopol 941 having a Brookfield viscosity (cP) at 25° C., 0.5% solution, of 4,000–11,000 (average molecular weight about 1,250,000), and Carbopol 934, having a Brookfield viscosity at 25° C., 0.5% solution, of 30,500–39,400 (average molecular weight about 3,000,000), are particularly suitable as gelling agents in the present composition. Carbopol is offered by the manufacturer to thicken and suspend insolubles, and to stabilize emulsions, primarily in aqueous systems. Therefore, it is not surprising that Carbopol is ineffective as a gelling agent for nonaqueous liquids, such as liquified halogenated hydrocarbon gases. Where Carbopol has been used to gel nonaqueous solutions, polar gelling adjuvants have been required. It has been observed that when Carbopol is mixed with Halon 1211, or a blend of Halon 1211 and 1301, there is no gelling effect. Carbopol is insoluble in Halon, and floats to the surface of the Halon liquid.

It has been discovered that if Carbopol is added to the liquid component with an ammonium compound fire-extinguishing powder such as monoammonium phosphate (in the form of ABC powder), Carbopol gels the relatively nonpolar fire-extinguishing liquids and liquified gases constituting the gelled liquid component, without the need for polar gelling adjuvants. The resulting suspension is thixotropic and displays excellent performance as a fire-extinguishing composition, even after extended storage. Satisfactory storage stability has been demonstrated up to 18 months. Powdered MAP did not pack or clog but remained in suspension forming a thixotropic composition which could be easily disseminated. MAP loadings of 40 to 66 weight percent have been possible with 0.5 to 4.0 weight percent Carbopol. A MAP concentration of 35 to 50 weight percent is preferred.

The composition may also contain gelling adjuvants. It has been found that aliphatic amines such as dicocoamine (Armeen 2C from Armak, Inc.) enhanced gel strength. Fumed silica, e.g., Cab-O-Sil (a trademark of the Cabot Corporation) and Tullanox (a trademark of Tulco, Inc.) may also be used as gelling adjuvants.

Gelling adjuvants may be present in the amount of 0.5 to 3.0 weight percent of the total composition. 1.0% is preferred. However, such adjuvants are not considered necessary for the preferred embodiment of the composition according to the present invention as set forth herein.

A preferred composition for use as a fire extinguisher contains the following ingredients in the following proportions:

EXAMPLE 1

Solids, 45% total (41.5% MAP and 3.5% Carbopol 941)

Halon, 55% (A blend of 80% Halon 1211 and 20% Halon 1301)

These proportions of powder, gellant, and liquified gas have been shown to provide the optimum in fire extinction, as determined in a standard Underwriters Laboratory 2-B-rated fire test (5 square feet of burning heptane). The fire was extinguished in 3.5 seconds, using approximately 216 grams or 50 weight percent of extinguisher contents.

Performance declines as the weight percent solids in the composition is increased above the optimum. More extinguishant is needed to extinguish the same size fire, until a concentration of solids is reached that is so high that expulsion of the extinguisher contents by the action of Halon is prevented. As the level of solids is decreased below the optimum (and percent Halon in the composition is proportionately increased) the extinguisher begins to act as a conventional Halon-type, until it is unable to extinguish a 2-B-rated fire.

A typical composition using mixed extinguishing powders, one of which is ammonium compound, is as follows:

EXAMPLE 2

Solids, 44% total (10% MAP, 30% $KHCO_3$ and 4% Carbopol)

Halon, 56% (A blend of 80% Halon 1211 and 20% Halon 1301)

The following experiments were performed demonstrating the increased fire-extinguishing effectiveness of the present gelled concentrate composition in comparison with Halon or MAP, when used alone.

EXAMPLE 3

Two hundred grams of monoammonium phosphate (ABC powder) in nitrogen pressurized to 100 p.s.i. was released on an Underwriters Laboratory 1-B-rated fire (2.5 square feet of burning heptane) (with 30 seconds pre-burn). The fire was not extinguished, despite expulsion of 95 weight percent of the contents of the containing vessel onto the fire.

EXAMPLE 4

In extinguishing hardware identical to that used in Example 3, 200 grams of a blend containing 80% Halon 1211 and 20% Halon 1301, by weight, was released on an identical fire. The fire was not extinguished, despite expulsion of 95 weight percent of the contents of the containing vessel onto the fire.

EXAMPLE 5

In extinguishing hardware identical to that used in Examples 3 and 4, 200 grams of the composition according to Example 1 was released on an identical fire. The fire was extinguished upon expulsion of 71 weight percent of the vessel contents.

Gelled concentrate compositions according to the present invention may be prepared by first mixing powders and gelling agent with an intensive mixer, then adding the liquid component, with continued mixing. Alternatively powder and gelling agent may be added to the pressureized liquid component, with intensive mixing.

The present invention may be embodied in other specific forms without departing from the spirit or essential attributes thereof and, accordingly, reference should be made to the appended claims, rather than to the foregoing specification, as indicating the scope of the invention.

I claim:

1. A thixotropic fire extinguishing composition of matter comprising:

a nonpolar nonaqueous gelled liquid;

an ammonium compound; and a polycarboxylated vinyl polymer having an average equivalent weight of about 76±4; a molecular weight of from about 450,000 to about 4,000,000; a Brookfield viscosity (cP) in a range of from about 4,000 to 60,000 as measured on a 0.5% solution, and about 3,000 to 7,000 as measured on a 1% solution; said polycarboxylated vinyl polymer having the general structure

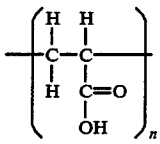

and being present in an amount sufficient to gel said liquid.

2. A composition according to claim 1 wherein the gelled liquid comprises at least one fire-quenching liquified gas.

3. A composition according to claim 2 wherein the gelled liquid comprises a blend of difluorochlorobromethane and trifluorobromomethane.

4. A composition according to claim 3 wherein the blend comprises about 80 weight percent difluorochlorobromomethane and about 20 weight percent trifluorobromomethane.

5. A composition according to claim 1 wherein the gelled liquid comprises at least one fire-quenching liquid and at least one fire-quenching liquified gas.

6. A composition according to claim 2 or 5 wherein the fire-quenching liquified gas is selected from the group consisting of trifluorobromomethane, difluorochlorobromomethane, perfluoropropane, perfluorocylobutane, dichlorodifluoromethane, tetrafluoromethane, methyl bromide, trifluoromethane, trifluorochloromethane and hexafluoroethane.

7. A composition according to claim 1 wherein the gelled liquid comprises at least one fire-quenching liquid and at least one overpressurizing gas selected from the group consisting of nitrogen, carbon dioxide, helium, and argon.

8. A composition according to claim 5 or 7 wherein the fire-quenching liquid is selected from the group consisting of methylene bromide, methyl iodide, tetrafluorodibromoethane, trifluorotrichloroethane, fluorotrichloromethane, chloroform, bromoform and carbon tetrachloride.

9. A composition according to claim 1 wherein the ammonium compound is selected from the group consisting of monoammonium phosphate, diammonium phosphate, triammonium phosphate and ammonium calcium phosphate.

10. A composition according to claim 1 additionally containing one or more powders selected from the group consisting of sodium bicarbonate, potassium bicarbonate, sodium chloride and potassium chloride.

11. A composition according to claim 1 additionally containing from about 0.5 to 3.0 weight percent gelling adjuvant selected from the group consisting of aliphatic amines and fumed silicas.

12. A composition according to claim 1 containing about 70–30 weight percent gelled liquid, about 0.5–8.0 weight percent polycarboxylated vinyl polymer, and about 30–70 weight percent ammonium compound selected from the group consisting of monoammonium phosphate, diammonium phosphate, triammonium phosphate, and ammonium calcium phosphate.

13. A fire extinguishing composition comprising the composition of claim 1 containing about 70–30 weight percent liquified gas which is a blend of about 80 weight percent difluorochlorobromomethane and about 20 weight percent trifluorobromomethane, about 0.5–8 weight percent polycarboxylated vinyl polymer and about 35–50 weight percent monoammonium phosphate.

14. A composition according to claim 13 comprising about 55 weight percent of said liquified gas blend, about 41.5 weight percent monoammonium phosphate, and about 3.5 weight percent polycarboxylated vinyl polymer.

15. A method of extinguishing a fire by applying the composition of claim 7, 13, or 14 to the fire.

16. The composition according to claim 1 wherein he polycarboxylated vinyl polymer has an average molecular weight of about 1,250,000 and a Brookfield viscosity, cP, at 25° C., 0.5% of 4,000–11,000.

17. The composition according to claim 1 wherein the polycarboxylated vinyl polymer has an average molecular weight of about 3,000,000 and a Brookfield viscosity, cP, at 25° C., 0.5% of 30,500–39,400.

18. The composition according to claim 1 wherein he polycarboxylated vinyl polymer has an average molecular weight of about 4,000,000 and a Brookfield viscosity, cP, at 25° C., 0.5% of 40,000–60,000.

19. The composition according to claim 1 wherein the polycarboxylated vinyl polymer has an average molecular weight of about 750,000 and a Brookfield viscosity, cP, at 25° C., 0.5% of 3,000–7,000.

* * * * *